US007985085B2

(12) United States Patent
Gao

(10) Patent No.: US 7,985,085 B2
(45) Date of Patent: Jul. 26, 2011

(54) LOCKING PROTECTIVE DOORS FOR ELECTRICAL SOCKETS

(75) Inventor: Shaohua Gao, Pinghu (CN)

(73) Assignee: Zhejiang Trimone Electric Science and Technology Co. Ltd., Pinghu (CN)

( * ) Notice: Subject to any disclaimer, the term of this patent is extended or adjusted under 35 U.S.C. 154(b) by 0 days.

(21) Appl. No.: 12/792,715

(22) Filed: Jun. 2, 2010

(65) Prior Publication Data

US 2011/0092085 A1 Apr. 21, 2011

(30) Foreign Application Priority Data

Oct. 20, 2009 (CN) ..... 2009 1 0153579

(51) Int. Cl.
*H01R 13/44* (2006.01)

(52) U.S. Cl. ..... 439/137

(58) Field of Classification Search ..... 439/135, 439/137, 145, 131
See application file for complete search history.

(56) References Cited

U.S. PATENT DOCUMENTS

| | | | |
|---|---|---|---|
| 2,552,061 | A | 5/1951 | Popp |
| 2,610,999 | A | 9/1952 | Silver |
| 4,595,894 | A | 6/1986 | Doyle et al. |
| 7,355,117 | B2 | 4/2008 | Castaldo et al. |

OTHER PUBLICATIONS

Gao, Shaohua, U.S. Appl. No. 12/792,719, "A Locking Door for an Electrical Outlet" filed Jun. 2, 2010, 20 pages.

*Primary Examiner* — Briggitte R Hammond
(74) *Attorney, Agent, or Firm* — Mei & Mark LLP

(57) ABSTRACT

An electrical socket with locking protective doors comprises an upper cover with first and second upper ports. A bottom case couples with the upper cover and has socket terminals. A middle frame may comprise mounting brackets. Adjustable, lockable large and small protective doors are between the upper cover and the middle frame. A lock mounting guide plate coupled to the middle frame comprises large and small guide plate ports corresponding to the upper ports. Large and small protective doors are located on the lock mounting guide plate, and the small protective door is located between the large protective door and the lock mounting guide plate. The upper ports and the guide plate ports correspond to and vertically align with the socket terminals. When the protective door is in a first position, it prevents an object from passing to the guide plate ports. When the protective door is in a second position, it allows plug pins to access to the guide plate ports.

12 Claims, 7 Drawing Sheets

LOCKING PROTECTIVE DOORS FOR ELECTRICAL SOCKETS

This application claims the benefit of priority of Chinese patent application 200910153579.4, filed Oct. 20, 2009, the content of which is incorporated herein by reference in its entirety.

This application is related to the U.S. Patent application entitled "A Locking Door for an Electrical Outlet" filed Jun. 2, 2010 by Shaohua Gao.

TECHNICAL FIELD

The present disclosure relates generally to electrical sockets and provides locking protective doors for restricted access to plug bush connections.

BACKGROUND

Existing technologies for the equipment and operation of electrical appliances in household or commercial buildings includes transmission of current through a current distribution system to the electrical appliances. In such a distribution system, traditional electrical socket consists of a pair of T holes or jacks, which are aligned with plug bush connections. Currently the pins of an electrical plug can be inserted into the jacks and reach the plug bush connections in the socket directly, achieving the electrical connection purpose. Because most of such sockets are used in dwelling buildings and are located near the ground, latent electric shocking danger exists for children and infants. For example, they may insert small objects into the jacks. Moreover, when electrical contact occurs with the wet mouth of a child, a passage of electricity from the live line through the body of the child to the ground will be formed, resulting in grounding failure and burning or electrical shocking. Besides the fingers and mouth, the children may also insert various conductive materials such as metal objects into the sockets. Many such objects are commonly used ones, such as clips, electroprobes, hairpins, matches, keys and coils. Believing such objects are safe, some parents do not restrict contact with them. For this reason, every dwelling building is required to install protective electrical sockets and grounding failure breakers in the current distribution system of the whole building.

As for the currently available circuit breaking device, e.g. the device described in U.S. Pat. No. 4,595,894, jointly owned, a tripping device is used to mechanically break the electrical connection among one or more input/output wires. Such a device can be reset after it trips when finding a grounding failure. However, the grounding failure current breaker only breaks the current after current is contacted. Therefore, unless there is a protective electrical socket, the person may still undergo the initial temporary electric shocking.

The other patents, such as U.S. Pat. Nos. 2,552,061 and 2,610,999 are characterized by a notched sliding plate on the upper cover. It must be removed manually to match the notched sliding plate being covered to allow plugging in or unplugging off the electrical socket notch. The sliding closing plate provides better protection while adding an extra material layer between the plug pins and the socket connections. This reduces the contact area between the plug pins and the connections, resulting in a latent temperature rise or a dangerous electric arc. The manually moveable plate has another shortcoming: children, through observation, may learn to expose the electrical socket.

U.S. Pat. No. 7,355,117 mentions a protective electrical socket with an automatic resetting sliding block in it. However, because of the structural restriction of the sliding block in such a protective electrical socket, the material consumption and the fabrication cost are high.

SUMMARY

The disclosure provides an electrical socket with locking protective doors that can prevent insertion of foreign objects other than the electrical plug pins, thereby achieving the protection function. Meanwhile, it has a simple structure and a low fabrication cost.

An embodiment provides an electrical socket with locking protective doors, comprising an upper cover comprising a first upper port and a second upper port. A bottom case is configured to cooperatively couple with the upper cover. The bottom case comprises at least one pair of socket terminals. A middle frame may be between the upper cover and the bottom case, the middle frame may comprise mounting brackets.

An adjustable lockable large protective door may be between the upper cover and the middle frame. An adjustable lockable small protective door may be between the upper cover and the middle frame. A lock mounting guide plate may be coupled to the middle frame. The lock mounting guide plate may comprise a large guide plate port corresponding to the first upper port and a small guide plate port corresponding to the second upper port.

The large protective door may be located on the lock mounting guide plate and the small protective door may be located between the large protective door and the lock mounting guide plate.

The first upper port and the second upper port may correspond to and vertically align with the at least one pair of socket terminals. The large guide plate port and the small guide plate port may correspond to and vertically align with the at least one pair of socket terminals.

When the protective door is in a first position, the protective door is configured to prevent an object from passing through the upper cover to the first guide plate port and the second guide plate port. When the protective door is in a second position, the protective door is configured to allow plug pins to access to the first guide plate port and the second guide plate from the upper cover.

An electrical socket having the locking protective door of this disclosure has the following beneficial effects. A small locking protective door is provided for a first "T"-shaped port on a 20A upper cover. The small locking protective door can prevent the insertion of foreign objects other than electrical plug pins, thereby achieving the protection function. Meanwhile, it has a simple structure and a low fabrication cost.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

FIG. 9B is a view along direction E of FIG. 9A.

DETAILED DESCRIPTION

Figure 1:
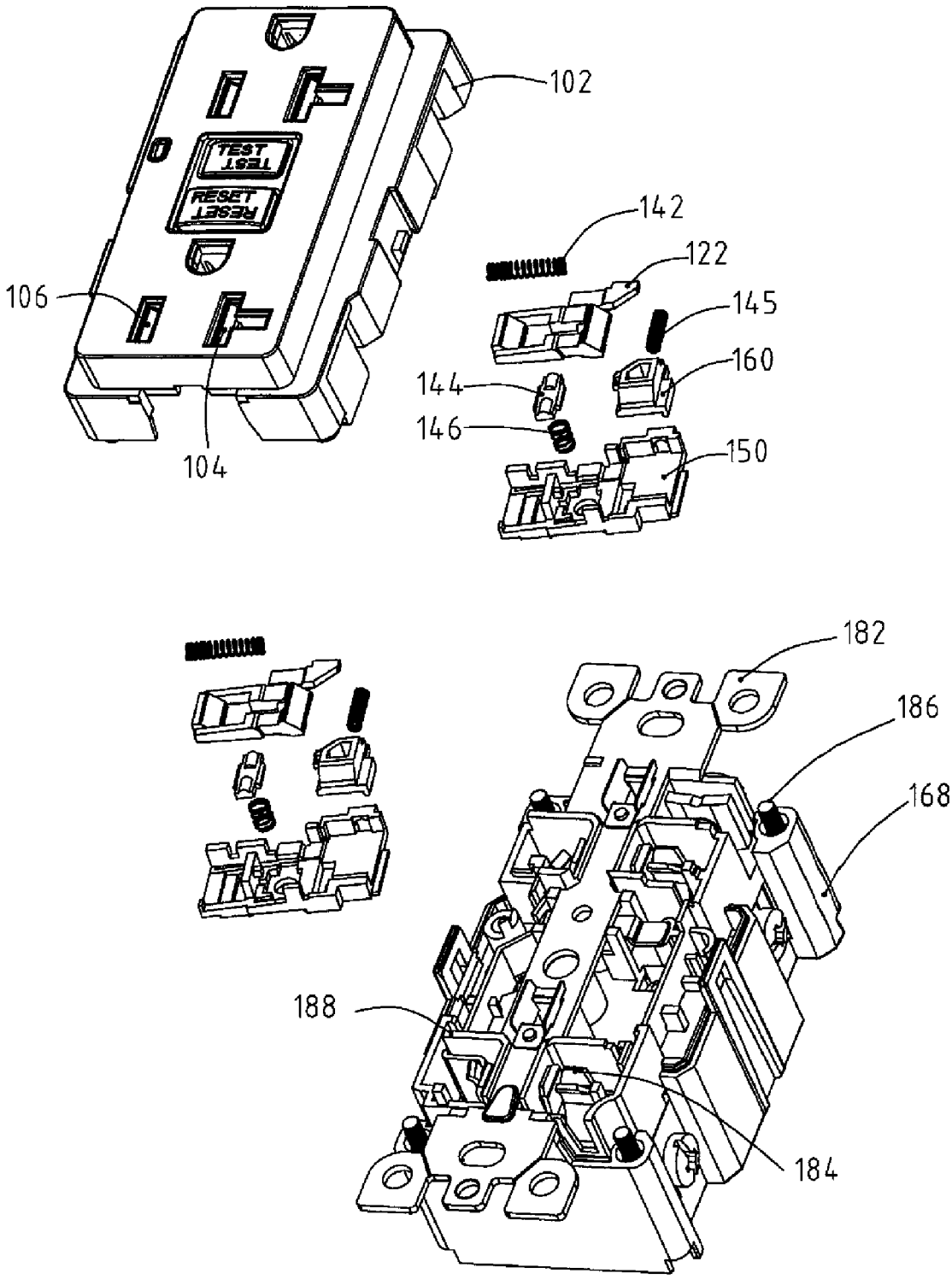
FIG. 1 is a schematic example of an electrical socket with a locking protective door.
Figure 2:
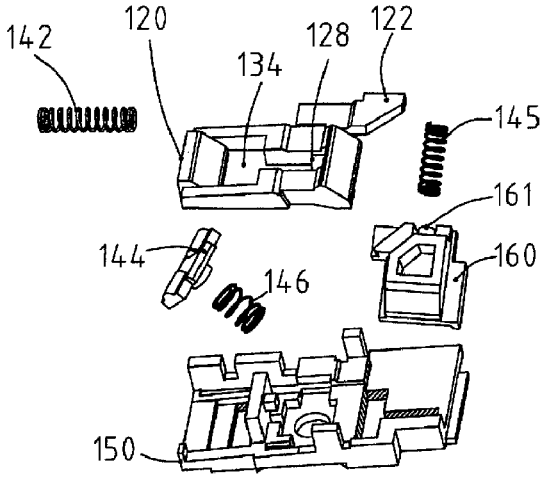
FIG. 2 is a schematic example of a large locking protective door, small locking protective door, and lock mounting guide plate.
Figure 3:
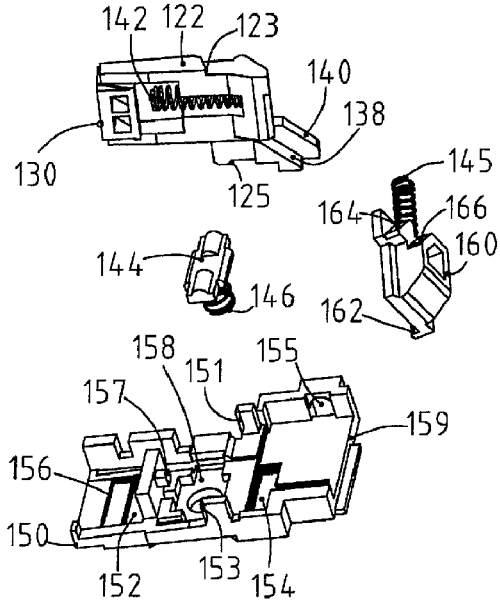
FIG. 3 is a schematic example of a large locking protective door, small locking protective door, and lock mounting guide plate.
Figure 4:
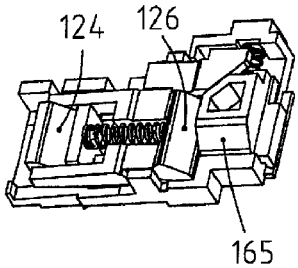
FIG. 4 is an example of an assembled locking protective door having a large locking protective door, small locking protective door, and lock mounting guide plate.
Figure 5:
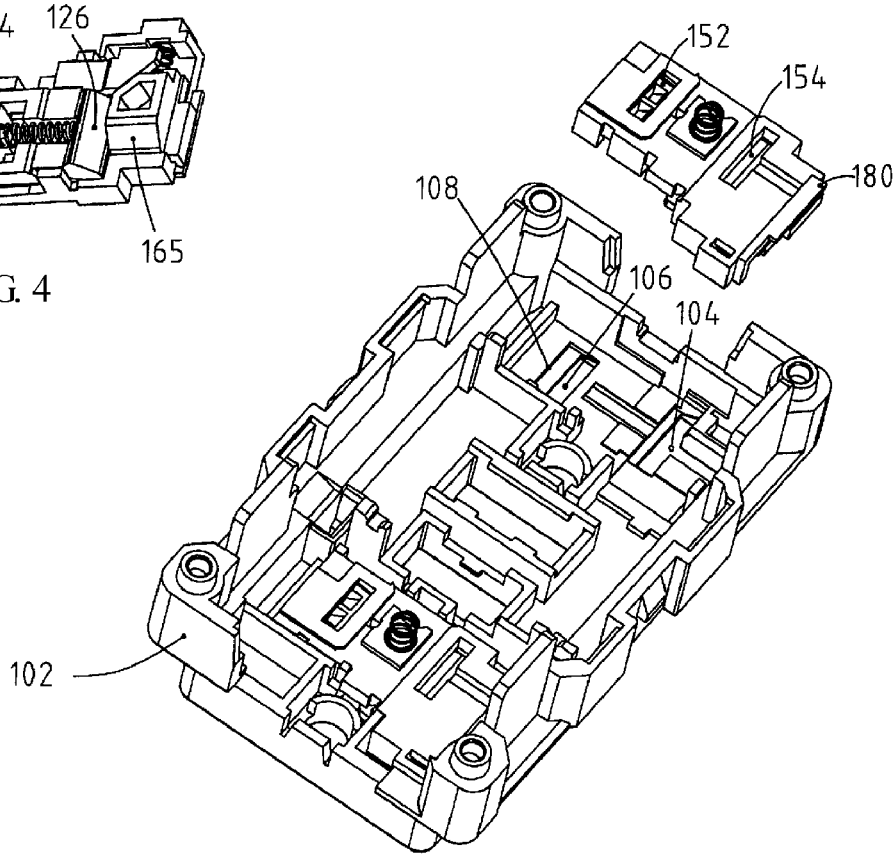
FIG. 5 is a schematic of an exemplary upper cover having locking protective doors.
Figure 6:
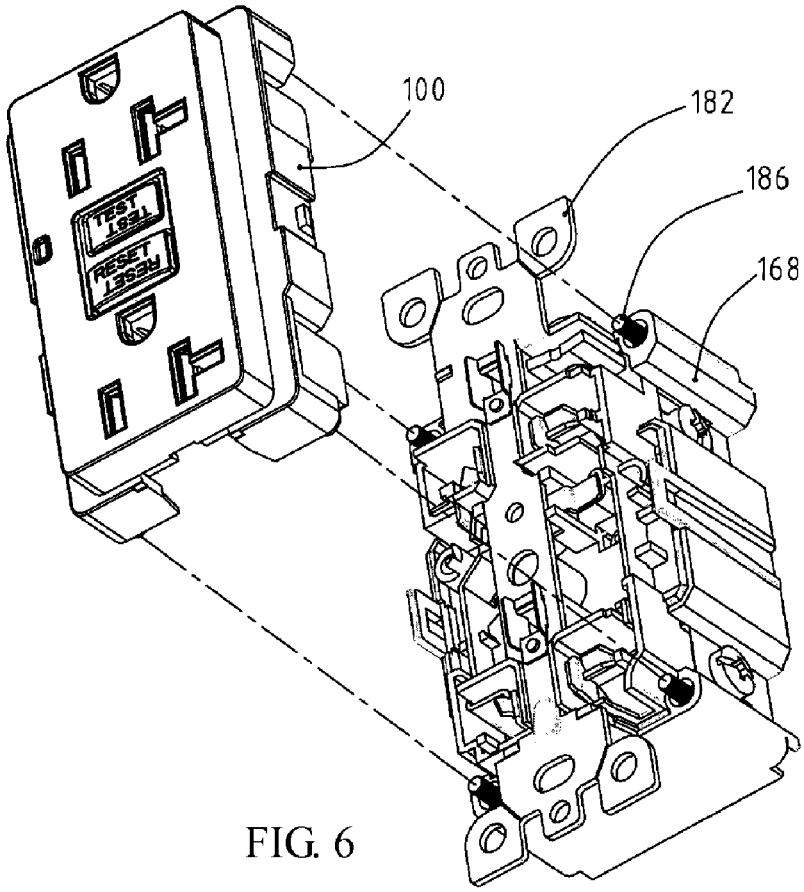
FIG. 6 is a schematic example of an electrical socket.
Figure 7:
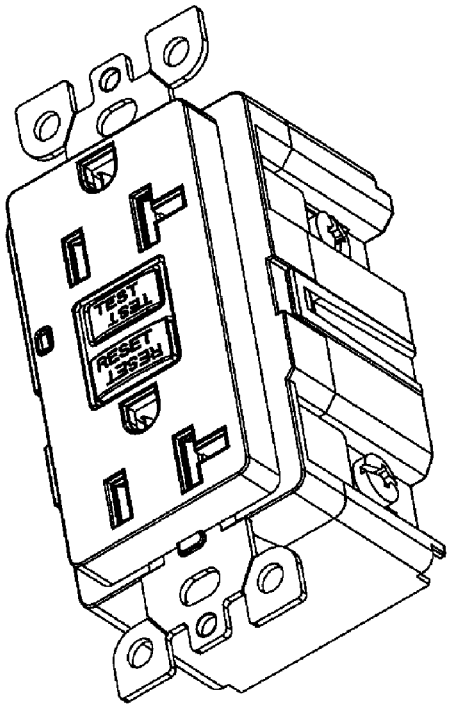
FIG. 7 is an example of a 20A electrical socket.

Reference will now be made in detail to the present exemplary embodiments, examples of which are illustrated in the accompanying drawings. Wherever possible, the same reference numbers will be used throughout the drawings to refer to the same or like parts.

As shown in FIGS. 1 through 17B, an electrical socket may have a locking protective door. The electrical socket is composed of a 20A upper cover 102 and a bottom case 168 corresponding to the 20A upper cover 102. A middle frame 185 is provided between 20A upper cover 102 and bottom case 168. Middle frame 185 is provided with a mounting bracket 182. Bottom case 168 is provided with at least one pair of socket terminals 184. 20A upper cover 102 is provided with a first port 104 and a second port 106 corresponding to socket terminals 184.

Large locking protective door 122 is provided between middle frame 185 and 20A upper cover 102. When large locking protective door 122 shelters first port 104 and second port 106, it is in the first position. When large locking protective door 122 moves away from first port 104 and second port 106 to allow plug pins to contact socket terminals 184, it is in the second position.

Middle frame 185 is provided with a lock mounting guide plate 150 corresponding to large locking protective door 122, and large locking protective door 122 is located on the lock mounting guide plate 150. Lock mounting guide plate has a large port 154 corresponding to first port 104 and a small port 152 corresponding to second port 106. Large port 154 and small port 152 correspond to socket terminals 184.

An adjustable small locking protective door 160 is provided between large locking protective door 122 and lock mounting guide plate 150. Small door spring 145 is provided between small locking protective door 160 and lock mounting guide plate 150. The small locking protective door 160 is provided with a first guide slope 164 and a second guide slope 166. Large locking protective door 122 is provided with a first guide notch 138 corresponding to first guide slope 164 and a second guide notch 140 corresponding to second guide slope 166. Small locking protective door 160 is provided with hook 162. Lock mounting guide plate 150 is provided with hook guide rail 159 corresponding to hook 162.

Large locking protective door 122 is provided with first slope 126 corresponding to first port 104. Large locking protective door 122 is provided with second slope 124 corresponding to second port 106. Second slope 124 is provided with an upper lock block 120. 20A upper cover 102 is provided with an upper notch 108 corresponding to upper lock block 120. Second slope 124 is provided with lower lock block 130. Lock mounting guide plate 150 is provided with a lower notch 156 corresponding to lower lock block 130.

On the inner side, first slope 126 is provided with a spring supporting shaft 128. Lock mounting guide plate 150 is provided with spring locating plate 157 corresponding to spring supporting shaft 128. Return spring 142 is provided between spring supporting shaft 128 and spring locating plate 157. Elevating jacking block 144 is provided between lock mounting guide plate 150 and large locking protective door 122. Elevating spring 146 is provided between lock mounting guide plate 150 and elevating jacking block 144.

Figure 18:
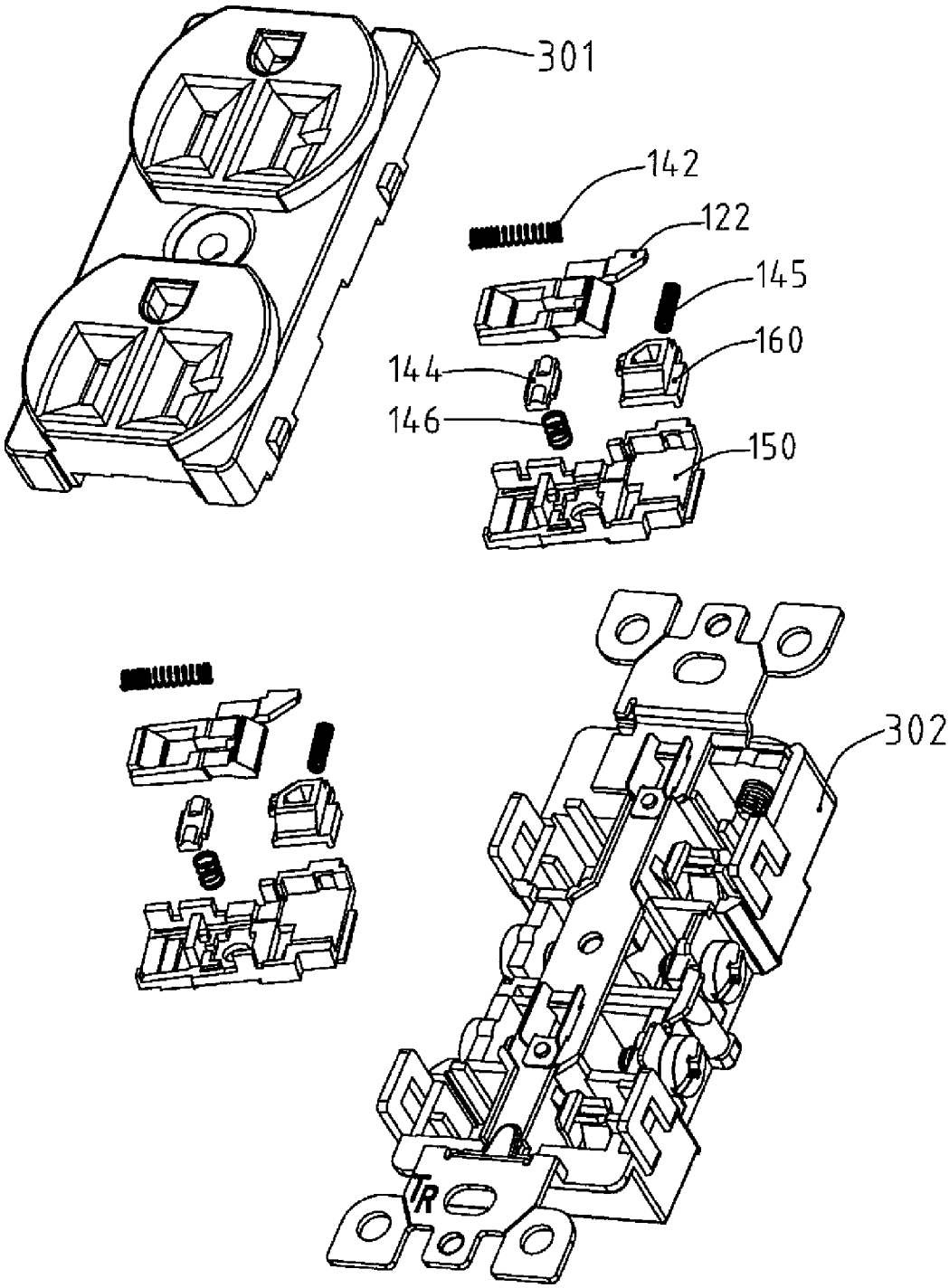
FIG. 18 is an exemplary schematic of a US-style 20A concave electrical socket having locking protective doors.

FIG. 18 shows the normal US-type 20A concave socket with a locking protective door structure. The locking protective door can prevent insertion of foreign objects other than electrical plug pins, achieving a protection function. Meanwhile, the socket has a simple structure and a low fabrication cost.

Figure 8A:
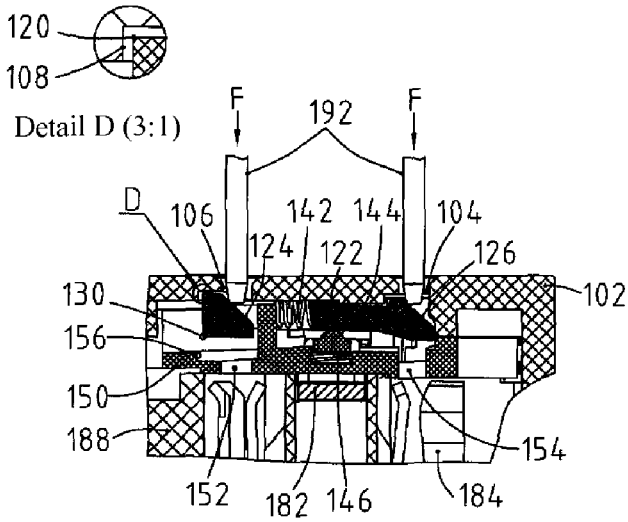
FIG. 8A is an example of an electrical socket and locking protective door before a 15A plug is fully inserted, including an enlargement of Detail D.
Figure 8B:
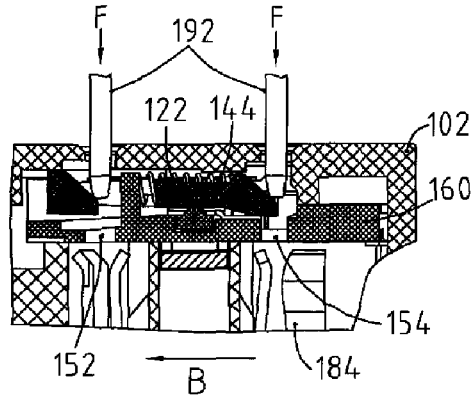
FIG. 8B is an example of an electrical socket and locking protective door during insertion of a 15A plug.

During the actual service of the electrical socket with a locking protective door, as shown in FIG. 8A, when the plug pins 192 of 15A plug are not inserted in, elevating spring 146 is in a certain compressive state, pushing the large locking protective door 122 upwards and acting to create a pressure balance and automatic compensation. This makes the upper lock block 120 be blocked in the upper notch 108.

When the plug pins 192 of 15A plug are inserted into the first port 104 and the second port 106, they contact with the first slope 126 and the second slope 124, further pressing the plug pins 192 downwards. Under the action of plug pin 192 and the first slope 126 and plug pin 192 and the second slope 124, large locking protective door 122 presses elevating jacking block 144 downwards, making elevating spring 146 compress. Meanwhile, large locking protective door 122 moves and compresses return spring 142.

Figure 12A:
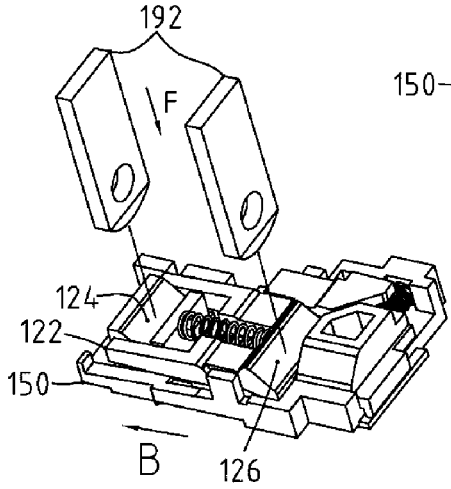
FIG. 12A is an example of a large locking protective door, small locking protective door, and lock mounting guide plate before a 15A plug is inserted.

As shown in FIG. 12A, when plug pins 192 of 15A plug are inserted in, small locking protective door 160 shields the large port 154. Plug pin 192 continues to press, as shown in FIG.

Figure 12B:
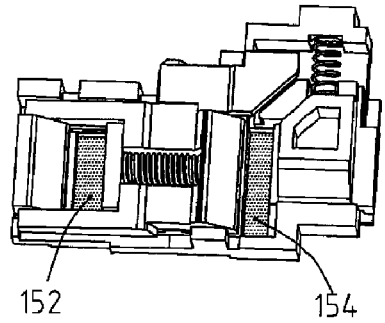
FIG. 12B is an example of a large locking protective door, small locking protective door, and lock mounting guide plate after a 15A plug is inserted.

8B, and large locking protective door 122 moves along Direction B. Meanwhile, as shown in FIG. 12B, plug pins 192 penetrate out of the small port 152 and large port 154 of large locking protective door 122, and contact with socket terminals 184 to electrify. When plug pins 192 are pulled out, protective door 122 recovers elastically under the action of elevating spring 146 and return spring 142, shielding the first port 104 and the second port 106.

Figure 9A:
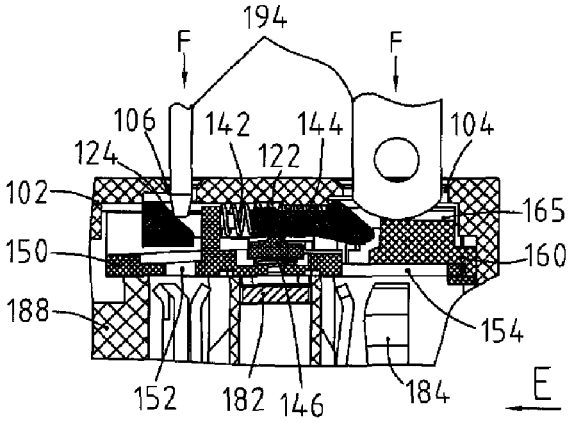
FIG. 9A is an example of an electrical socket and locking protective door before a 20A plug is fully inserted.
Figure 9A:
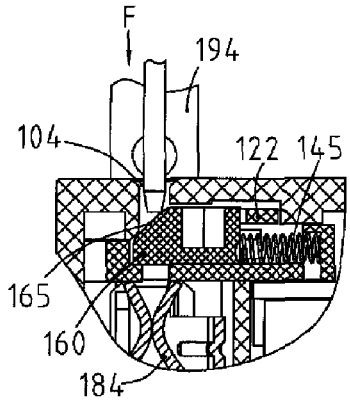

As shown in FIGS. 9A and 9B, plug pins 194 of 20A plug are inserted into the first port 104 and the second port 106. The plug 194 inserted into the second port 106 firstly contacts with the second slope 204. Then it is inserted further downwards, as shown in Detail D. When upper lock block 120 disengages with upper notch 108, the plug 194 inserted into the first port 104 contacts with slope 165 in small locking protective door 160.

Figure 13A:
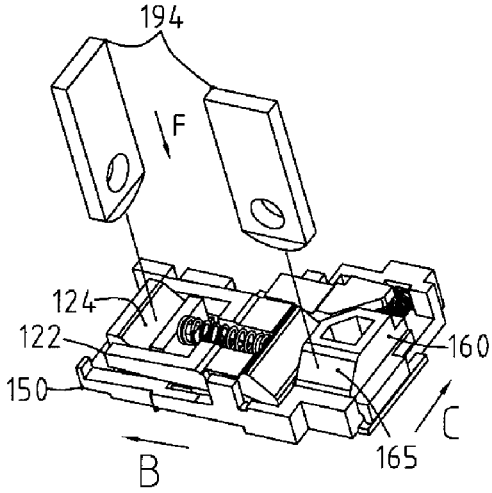
FIG. 13A is an example of a large locking protective door, small locking protective door, and lock mounting guide plate before a 20A plug is inserted.
Figure 13B:
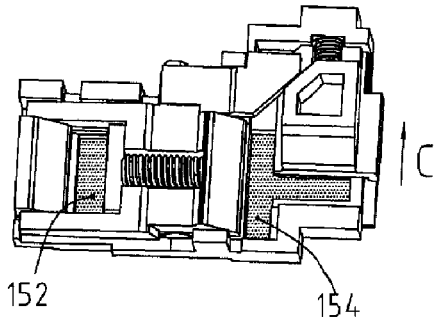
FIG. 13B is an example of a large locking protective door, small locking protective door, and lock mounting guide plate after a 20A plug is inserted.
Figure 14A:
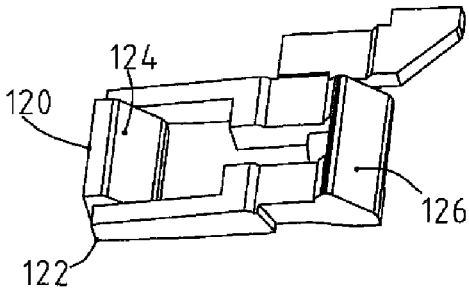
FIG. 14A is an example of a large locking protective door.
Figure 14B:
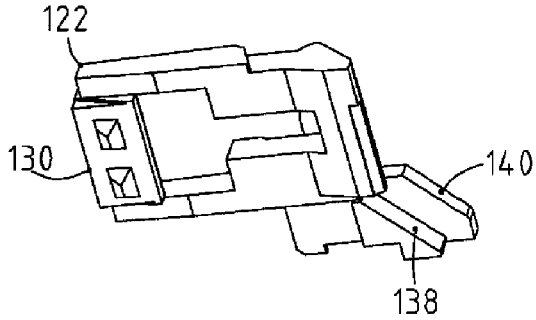
FIG. 14B is an example of a large locking protective door.
Figure 15A:
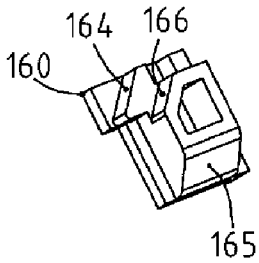
FIG. 15A is an example of a small locking protective door.
Figure 15B:
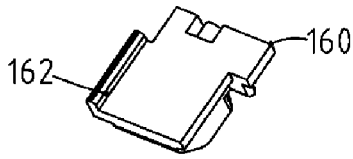
FIG. 15B is an example of a small locking protective door.
Figure 16A:
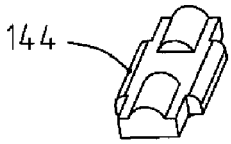
FIG. 16A is an example of an elevating jacking block.
Figure 16B:
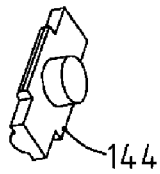
FIG. 16B is an example of an elevating jacking block.
Figure 17A:
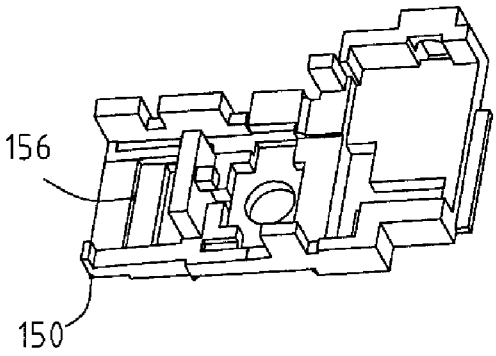
FIG. 17A is an example of a lock mounting guide plate.
Figure 17B:
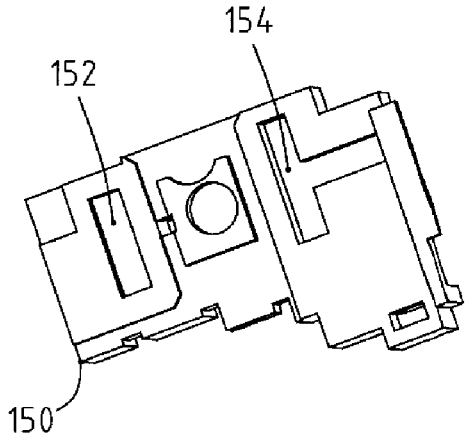
FIG. 17B is an example of a lock mounting guide plate.

The plug is inserted further downwards, as shown in FIGS. 13A and 13B. Under the action of the plug pin 194 inserted into the second port 106 and of the second slope 124, large locking protective door 122 moves along Direction B. Under the action of the plug pin 194 inserted into the first port 106 and of slope 165 in small locking protective door 165, small locking protective door 160 moves along the C direction to the position shown. Plug pins 194 of 20A plug penetrate through small port 152 and large port 154 of large locking protective door 122 and contact with socket terminals 184 to electrify. When plug pins 194 of 20A plug are pulled out, large locking protective door 122 recovers elastically under the action of elevating spring 146 and recovery spring 142, and small locking protective door 160 recovers elastically under the action of small door spring 145, thereby shielding the first port 104 and the second port 106.

When small locking protective door 160 is acted on by an inserted object singly, large locking protective door 122 does not move, as the upper lock block 120 is blocked in the upper notch 108. First guide slope 164 on small locking protective door 160 acts with the corresponding first guide notch 138, and the second guide slope 166 acts with the corresponding first guide notch 140, making the small locking protective door be locked against the force of the inserted object and unmovable.

Figure 10A:
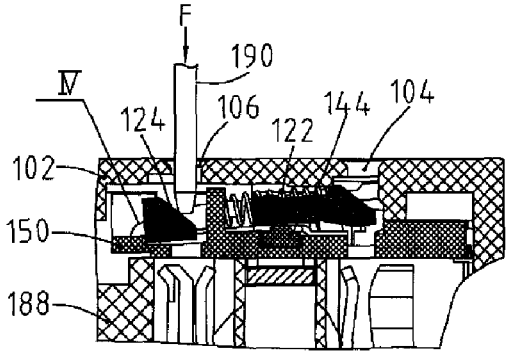
FIG. 10A is an example of an electrical socket and locking protective door having a foreign object inserted.

As shown in FIG. 10A, when a foreign object 190 is inserted into second port 106, foreign object 190 contacts second slope 124 and pushes second slope 124 downwards. At this time, elevating spring 146 and recovery spring 142 perform pressure balance and automatic compensation to large locking protective door 122. As shown in Position IV, lower lock block 130 on second slope 124 is clamped closely in lower notch 156, thereby restricting the movement of large locking protective door 122. Unless large locking protective door 122 breaks, it will not be moved no matter how large a force is applied in any direction.

Figure 10B:
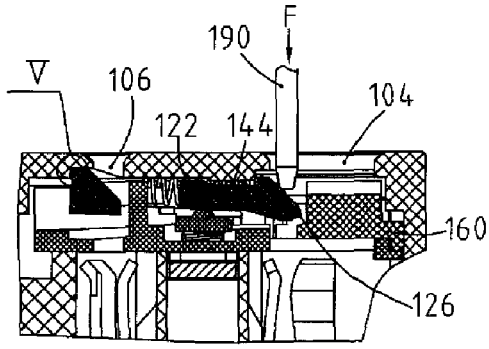
FIG. 10B is an example of an electrical socket and locking protective door having a foreign object inserted.
Figure 11:
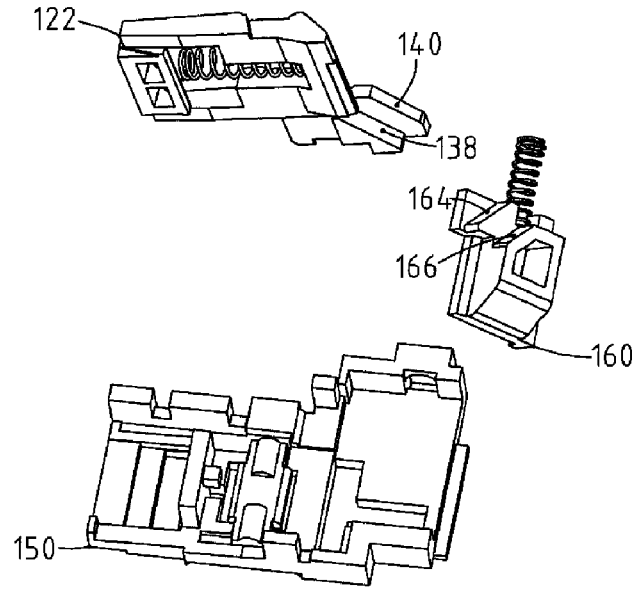
FIG. 11 is a schematic of a large locking protective door, a small locking protective door, and a lock mounting guide plate.

As shown in FIG. 10B, when foreign object 190 is inserted into first port 104, foreign object 190 contacts first slope 126 and pushes first slope 126 downwards. At this time, elevating spring 146 and recovery spring 142 perform pressure balance and automatic compensation to large locking protective door 122. As shown in Position V, upper lock block 120 on second slope 124 is clamped closely in upper notch 108, thereby making large locking protective door 122 unmovable. When continuing to push first slope 126 downwards, upper lock block 120 fits with upper notch 108 more tightly. Unless large locking protective door 122 breaks, it will not be moved no matter how large a force is applied in any direction.

With the locking protective door, the plug can be inserted easily when the insertion pressure is balanced, while foreign objects can not be inserted in any direction. This can prevent insertion of foreign objects other than electrical plug pins, thereby achieving the protection function. Meanwhile, it has a simple structure and a low fabrication cost.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. An electrical socket with locking protective doors, comprising:

an upper cover comprising a first upper port and a second upper port;

a bottom case configured to cooperatively couple with the upper cover, the bottom case comprising at least one pair of socket terminals;

a middle frame between the upper cover and the bottom case, the middle frame comprising mounting brackets;

an adjustable lockable large protective door between the upper cover and the middle frame;

an adjustable lockable small protective door between the upper cover and the middle frame; and a lock mounting guide plate coupled to the middle frame, the lock mounting guide plate comprising a large guide plate port corresponding to the first upper port and a small guide plate port corresponding to the second upper port, wherein the large protective door is located on the lock mounting guide plate and the small protective door is located between the large protective door and the lock mounting guide plate, wherein the first upper port and the second upper port correspond to and vertically align with the at least one pair of socket terminals, wherein the large guide plate port and the small guide plate port correspond to and vertically align with the at least one pair of socket terminals, wherein, when the large protective door is in a first position, the large protective door is configured to prevent an object from passing through the upper cover to the large guide plate port and the small guide plate port, and wherein, when the large protective door is in a second position, the large protective door is configured to allow plug pins to access the large guide plate port and the small guide plate port from the upper cover.

2. The electrical socket of claim 1, further comprising a small door spring between the small protective door and the lock mounting guide plate.

3. The electrical socket of claim 1, wherein:

the small protective door further comprises a first guide slope and a second guide slope, and the large protective door further comprises a first guide notch corresponding to the first guide slope and a second guide notch corresponding to the second guide slope.

4. The electrical socket of claim 1, wherein:

the small protective door further comprises a hook, and the lock mounting guide plate further comprises a hook guide rail corresponding to the hook.

5. The electrical socket of claim 1, wherein the large protective door further comprises:

a first slope corresponding to the first upper port; and a second slope corresponding to the second upper port.

6. The electrical socket of claim 5, wherein:

the second slope further comprises an upper lock block, and the upper cover further comprises an upper notch corresponding to the upper lock block.

7. The electrical socket of claim 5, wherein:

the second slope further comprises a lower lock block, and the lock mounting guide plate further comprises a lower notch corresponding to the lower lock block.

8. The electrical socket of claim 5, further comprising:

a spring supporting shaft on an inner side of the first slope;

a spring locating plate on the lock mounting guide plate, the spring locating plate corresponding to the spring supporting shaft; and a return spring between the spring supporting shaft and the spring locating plate.

9. The electrical socket of claim 1, further comprising:

an elevating jacking block between the lock mounting guide plate and the large protective door; and an elevating spring between the lock mounting guide plate and the elevating jacking block.

10. The electrical socket of claim 1, wherein the first upper port and the second upper port are configured to accept 20A plugs.

11. The electrical socket of claim 1, wherein the first upper port and the second upper port are configured to accept 15 A plugs.

12. The electrical socket of claim 1, wherein:

when the small protective door is in a first position, the small protective door is configured to prevent an object from passing through the upper cover to the large guide plate port, and when the small protective door is in a second position, the small protective door is configured to allow a portion of a plug pin to access the large guide plate port from the upper cover.

* * * * *